US007715775B2

(12) United States Patent
Shiozawa

(10) Patent No.: US 7,715,775 B2
(45) Date of Patent: May 11, 2010

(54) IMAGE GLOSSING APPARATUS

(75) Inventor: Motohide Shiozawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 12/143,182

(22) Filed: Jun. 20, 2008

(65) Prior Publication Data

US 2009/0010691 A1 Jan. 8, 2009

(30) Foreign Application Priority Data

Jul. 3, 2007 (JP) ..... 2007-174698

(51) Int. Cl.
*G03G 15/20* (2006.01)

(52) U.S. Cl. ..... 399/341; 399/328; 399/329; 399/333; 399/322; 399/400; 430/124.32

(58) Field of Classification Search ..... 399/341; 430/124.32
See application file for complete search history.

(56) References Cited

U.S. PATENT DOCUMENTS 7,074,538 B2 7/2006 Hosoi et al.
2003/0180063 A1 * 9/2003 Kanesawa et al. ..... 399/69

FOREIGN PATENT DOCUMENTS

JP 04344680 A * 12/1992
JP 5-158364 A 6/1993
JP 5-333643 A 12/1993
JP 2002-372882 A 12/2002
JP 2004-198844 A 7/2004
JP 2004-325934 A 11/2004

OTHER PUBLICATIONS

Translation of Abstract—JP 04344680.*

* cited by examiner

*Primary Examiner*—David P Porta
*Assistant Examiner*—Bryan P Ready
(74) *Attorney, Agent, or Firm*—Fitzpatrick, Cella, Harper & Scinto

(57) ABSTRACT

The present invention provides a glossing apparatus including first and second heating rotating members which contact each other to form a nip part, an toner image on a recording material being heated in the nip part; a cooling unit which cools the recording material, moved while contacting the first heating rotating member, before the recording material is separated from the first heating rotating member; and a mode performing unit which performs a high-gloss mode and a low-gloss mode, the recording material is conveyed to and heated by the nip part such that the toner image contact the first heating rotating member in the high-gloss mode, the recording material is conveyed to and heated by the nip part such that the toner image contact the second heating rotating member in the low-gloss mode.

4 Claims, 10 Drawing Sheets

IMAGE GLOSSING APPARATUS

BACKGROUND OF THE INVENTION

1. Field of the Invention

The present invention relates to a glossing apparatus used in an image forming apparatus such as an electrophotographic system copying machine and electrophotographic system printer, particularly to a glossing apparatus which can form an image having different gloss levels.

2. Description of the Related Art

Conventionally, for the glossing apparatus which can form images having the different gloss levels, Japanese Patent Application Laid-Open No. 2004-325934 discloses a glossing apparatus in which, using a fixing belt including a plurality of areas with different degrees of smoothness, the area of the fixing belt used can be selected according to the desired gloss level of the image.

However, in the glossing apparatus disclosed in Japanese Patent Application Laid-Open No. 2004-325934, the fixing belt having a length more than double the largest recording material which can be used is required to be able to form the image having the high-gloss and low-gloss levels, which results in an inevitably enlarged apparatus.

SUMMARY OF THE INVENTION

The present invention provides an image an image glossing apparatus which can form images having the different gloss levels while the enlargement of the apparatus is suppressed. The invention also provides an image forming apparatus including the following image glossing apparatus.

The present invention provides an image glossing apparatus comprising: first and second heating rotating members which contact each other to form a nip portion, an toner image on a recording material being heated in the nip portion, a surface of the second heating rotating member being rougher than a surface of the first heating rotating member; a cooling unit which cools the recording material, moved while contacting the first heating rotating member, before the recording material is separated from the first heating rotating member; and a mode performing unit which performs a high-gloss mode and a low-gloss mode, the recording material is conveyed to and heated by the nip portion such that the toner image contacts the first heating rotating member in the high-gloss mode, the recording material is conveyed to and heated by the nip portion such that the toner image contacts the second heating rotating member in the low-gloss mode.

Further features of the present invention will become apparent from the following description of exemplary embodiments with reference to the attached drawings.

DESCRIPTION OF THE EMBODIMENTS

A glossing apparatus according to an exemplary embodiment of the invention will be described below with reference to the drawings.

(Image Forming Apparatus)

Figure 1:
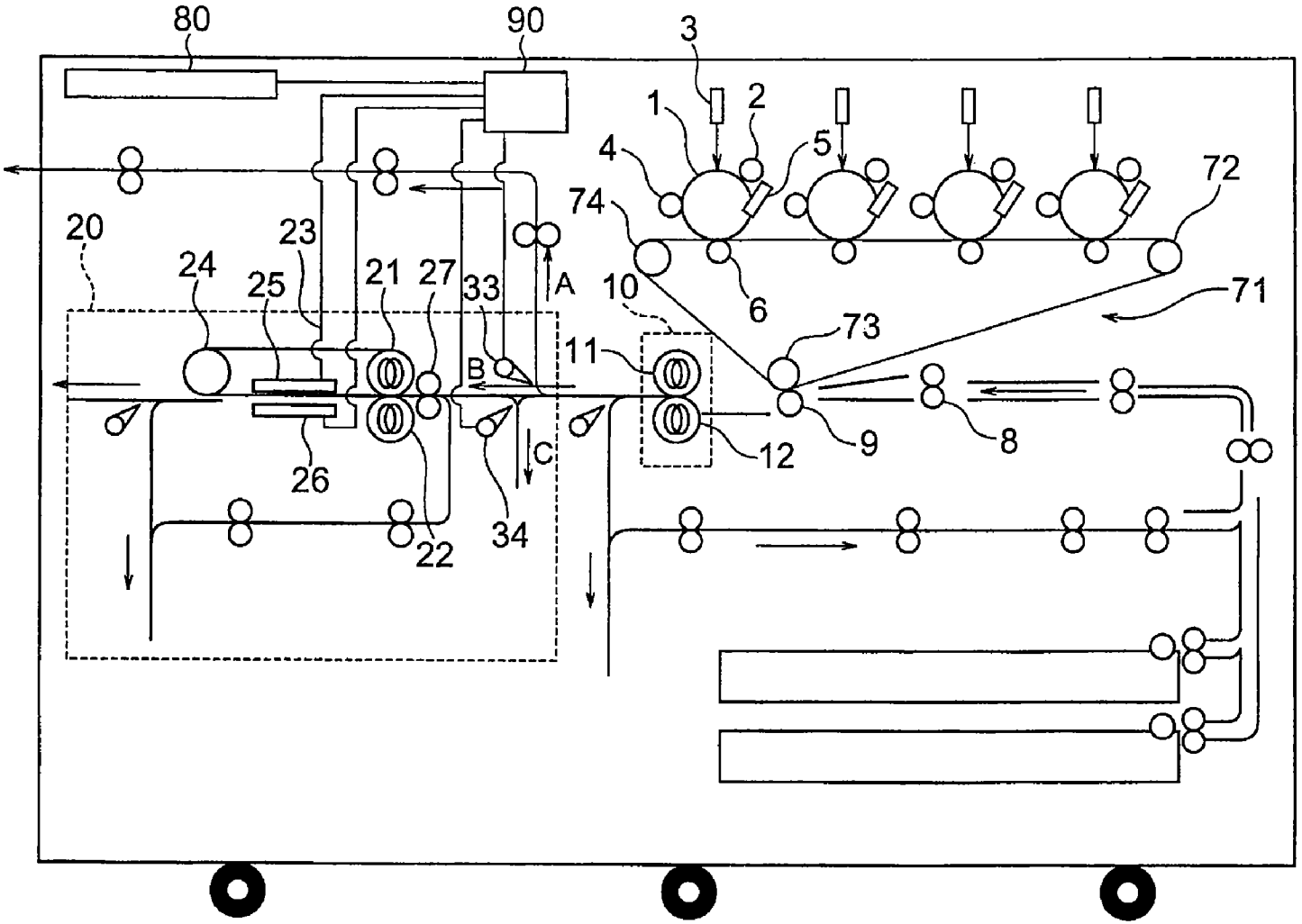
FIG. 1 illustrates a configuration of an image forming apparatus according to an embodiment of the invention.
Figure 9:
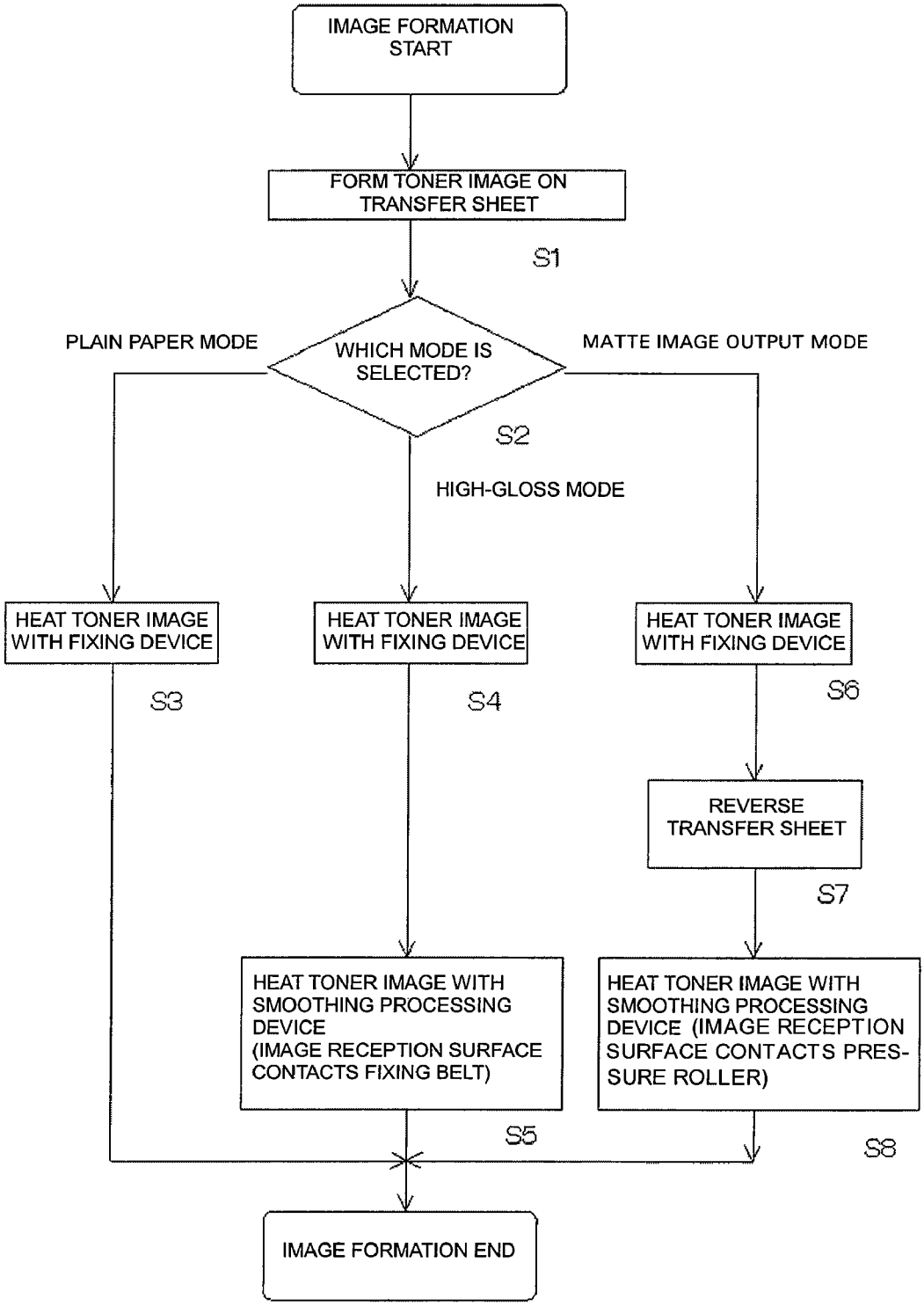
FIG. 9 is a flowchart of image formation.

FIG. 1 illustrates a configuration of an image forming apparatus according to an embodiment of the invention. As illustrated in FIG. 1, a color printer in which an intermediate transfer member is used and a smoothing processing portion (smoothing processing unit 20) which is the glossing apparatus are combined in the image forming apparatus. FIG. 9 is a flowchart illustrating image formation performed by the image forming apparatus of the embodiment. The image forming apparatus of the embodiment will be described below referring to FIG. 9 as appropriate.

In an image forming unit, four image forming stations are substantially horizontally arranged, that is, the yellow (Y), magenta (M), cyan (C) and black (K) image forming stations which form yellow, magenta, cyan, and black developer images are arranged from the left side of FIG. 1. The image forming stations have the same configuration except that the image forming stations differ from one another in the developer color.

In the image forming stations, primary charging members 2Y, 2M, 2C, and 2K, image exposure units 3Y, 3M, 3C, and 3K, development devices 4Y, 4M, 4C, and 4K, and cleaning devices 5Y, 5M, 5C, and 5K are disposed around photosensitive drums 1Y, 1M, 1C, and 1K respectively.

An intermediate transfer belt 71 which is an intermediate transfer member is rotatably entrained about a driving roller 74, a driven roller 72, and a backup roller 73 so as to abut on the photosensitive drums 1Y, 1M, 1C, and 1K. The driving roller 74 is driven by a motor (not illustrated). Primary transfer rollers 6Y, 6M, 6C, and 6K are provided across the intermediate transfer belt 71 from the photosensitive drums 1Y, 1M, 1C, and 1K. The driven roller 72 is also used as a tension roller such that the intermediate transfer belt 71 does not sag.

A secondary transfer roller 9 is disposed while facing the backup roller 73, and the secondary transfer roller 9 is connected to a high-voltage power supply in order to supply a transfer bias necessary for the transfer to the secondary transfer roller 9. A registration roller pair 8 is provided on an upstream side of the backup roller 73 in a sheet conveying direction, and a fixing device 10 is provided on a downstream side of the backup roller 73 in the sheet conveying direction. The fixing device 10 includes a fixing roller 11 and a pressure roller 12, and a heater which is a heat source is incorporated in the fixing roller 11 or the heaters are incorporated in the fixing roller 11 and the pressure roller 12.

The image forming apparatus includes conveying path switching members 33 and 34 and a smoothing processing device 20. The conveying path switching members 33 and 34 are located on the downstream side of the fixing device 10 in the sheet conveying direction. The smoothing processing device 20 is located on the downstream side of the conveying path switching member 34 in the sheet conveying direction.

FIG. 2 is an explanatory view illustrating operations of the conveying path switching members 33 and 34. As illustrated in FIG. 2, in the conveying path switching members 33 and 34, fins are rotatable about turning shafts 33*a* and 34*a* respectively.

A conveying path which guides a transfer sheet P passing through the fixing device 10 includes a first path, a second path, and a third path. As shown by an arrow A in FIG. 1, through the first path, the transfer sheet P is conveyed to the outside of the image forming apparatus while avoiding the smoothing processing portion 20.

As shown by an arrow B in FIG. 1, through the second path, the transfer sheet P is horizontally conveyed to the smoothing processing device 20. Through the third path (switchback path, reversing unit), the transfer sheet P (recording material) is conveyed as shown by an arrow C in FIG. 2, and switchback of the transfer sheet P is performed to reverse the transfer sheet P. Then, the transfer sheet P is conveyed to the second path.

Figure 2A:
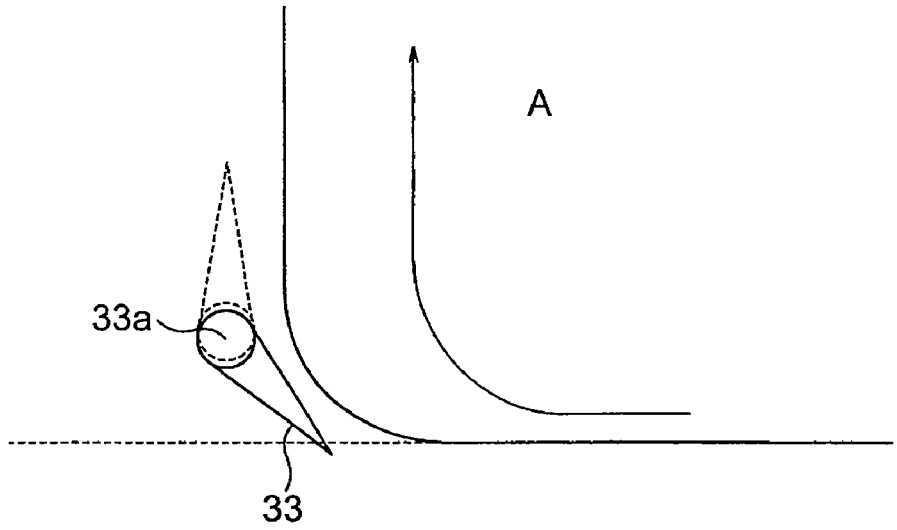
FIGS. 2A to 2D are explanatory views illustrating an operation of a conveying path switching member.

In a case where the conveying path switching member 33 is located at a position shown by a solid line of FIG. 2A, the transfer sheet P is guided toward a direction of the arrow A in FIG. 2. In the case where the conveying path switching member 34 is located at a position shown by a solid line of FIG. 2C while the conveying path switching member 33 is located at a position shown by a solid line of FIG. 2B, the transfer sheet P is guided toward a direction of the arrow C in FIG. 2 and conveyed to the third path.

Figure 2B:
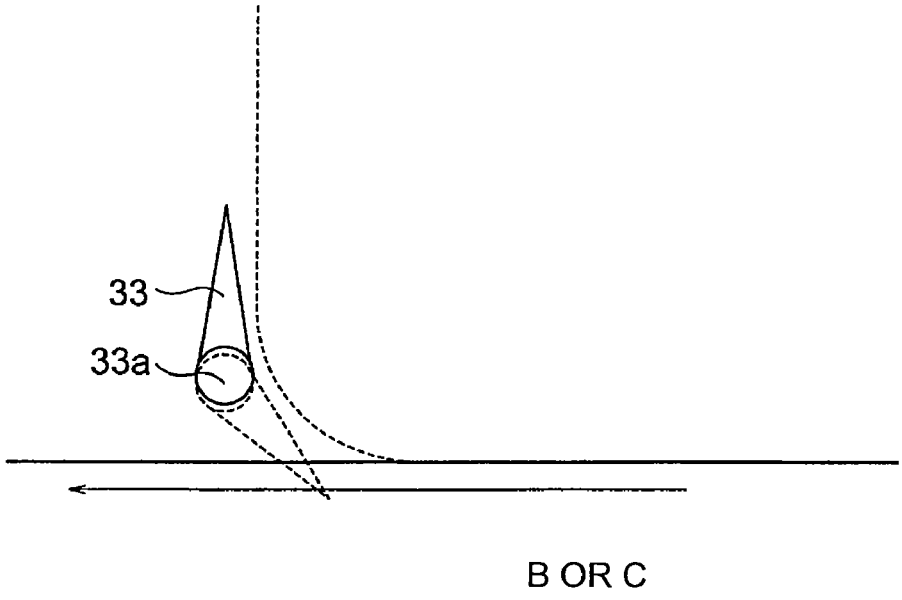
Figure 2C:
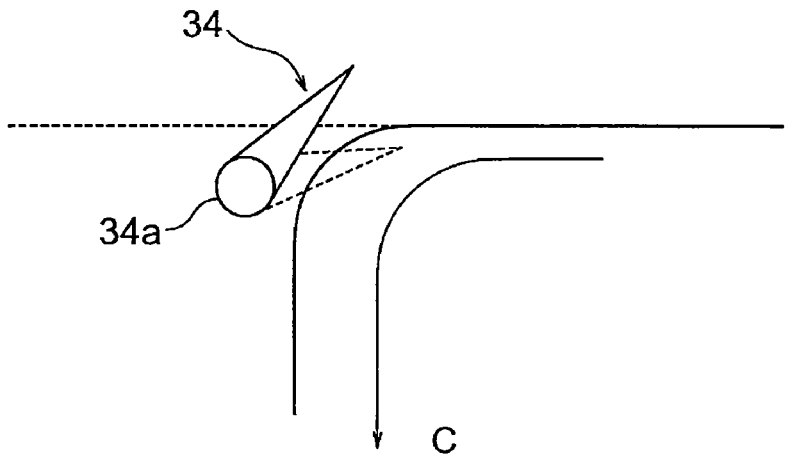
Figure 2D:
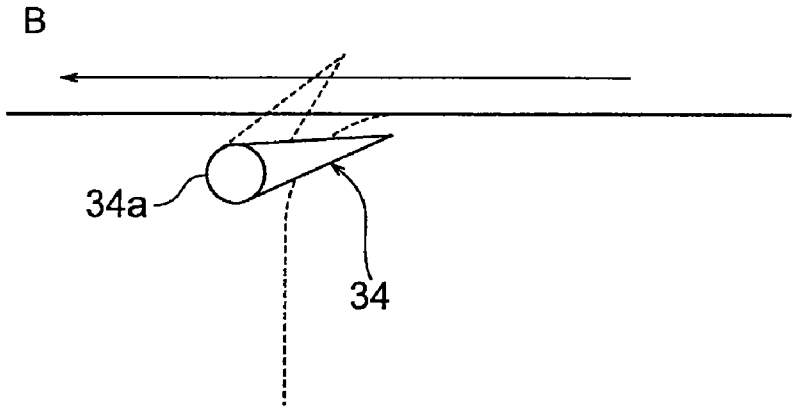

In a case where the conveying path switching member 34 is located at a position shown by a solid line of FIG. 2D while the conveying path switching member 33 is located at the position shown by the solid line of FIG. 2B, the transfer sheet P is guided toward the direction of the arrow B in FIG. 2 and conveyed to the second path.

(Operation of Image Forming Apparatus)

The whole of the image forming apparatus is operated at a process speed of 130 mm/s. During image formation, a surface of the photosensitive drum 1 rotated counterclockwise in FIG. 1 is evenly charged by the primary charging member 2, an image exposure unit 5 emits a laser beam to form an electrostatic latent image according to an image signal. The development device 3 develops the latent image to form a visible image in the form of a developer image (toner image) using a developer.

The transfer bias is applied to the primary transfer roller 6 to primarily transfer the developer image to the intermediate transfer belt 71 in a primary transfer portion which is a nip portion between the intermediate transfer belt 71 and the primary transfer roller 6.

The yellow, magenta, cyan, and black developer images formed by the image forming stations are transferred to the intermediate transfer belt 71 while superimposed with one another, thereby forming a color image on the intermediate transfer belt 71.

The backup roller 73 and the secondary transfer roller 9 constitute a secondary transfer nip portion while facing each other. The registration roller pair 8 delivers the transfer sheet P to the transfer nip portion in synchronization with the toner image position on the intermediate transfer belt 71.

The transfer bias is applied to the secondary transfer roller 9 to secondarily transfer the toner image to the transfer sheet P, thereby recording the image (S1 of FIG. 9).

The transfer sheet P to which the toner image is transferred is conveyed to the fixing device 10. The surface of the fixing roller 11 is controlled at a temperature of 180° C., and the surface of the pressure roller 12 is controlled at a temperature of 150° C. The fixing roller 11 and the pressure roller 12 form the fixing nip with a total pressure of 50 kg. When the transfer sheet P passes through the fixing nip, the toner is fixed to the transfer sheet P by heating and pressurizing.

Figure 8:
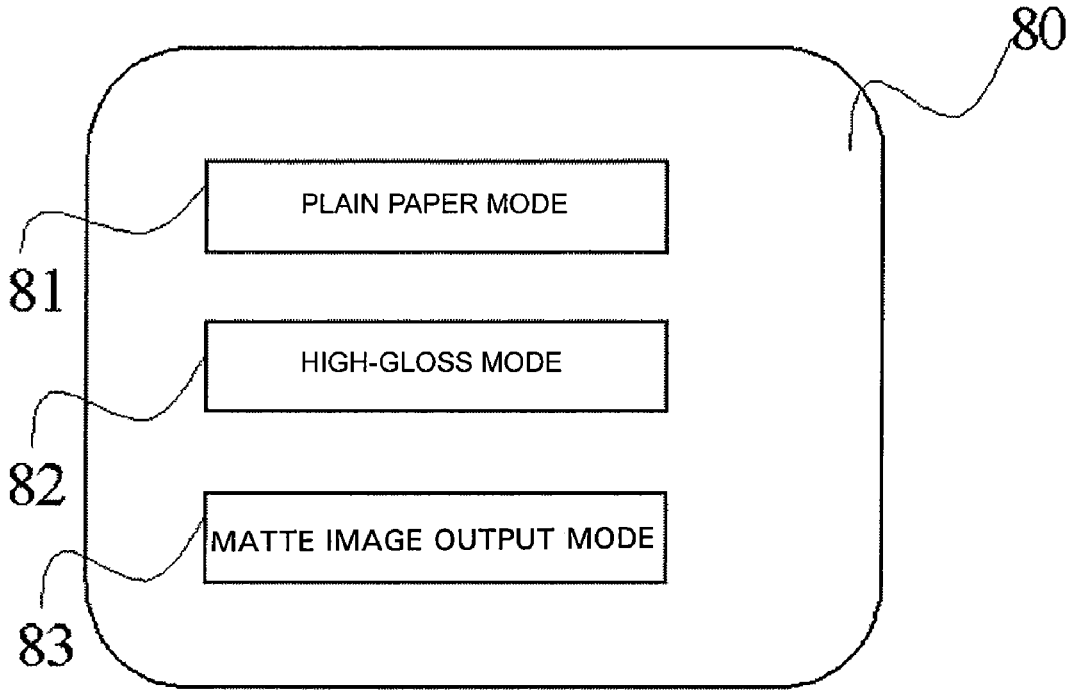
FIG. 8 is a view explaining an operation panel.

A plain paper mode, a high-gloss mode, and a matte image output mode (low-gloss mode) can be selected in the image forming apparatus. In the plain paper mode, the image is formed on plain paper. In the high-gloss mode, a high-gloss image is outputted to coated paper. In the matte image output mode, a low-gloss image is outputted to the coated paper. The modes can be selected through an operation panel 80 of FIG. 1. FIG. 8 illustrates the detailed operation panel 80. The modes can be selected by pressing keys 81, 82, and 83 of the operation panel 80. Key 81 is used to select the plain paper mode, key 82 is used to select the high-gloss mode, and key 83 is used to select the matte image output mode.

When the plain paper mode is selected (S2 of FIG. 9), a controller (mode performing unit) 90 sets the conveying path switching member 33 to the position shown by the solid line of FIG. 2A, and the fixing device 10 heats and fixes the toner image to the transfer sheet P (S3 of FIG. 9). Then, the transfer sheet P is conveyed to the outside of the image forming apparatus while avoiding the smoothing processing device 20. When the high-gloss mode is selected (S2 of FIG. 9), the controller 90 sets the conveying path switching member 33 and the conveying path switching member 34 to the position shown by the solid line of FIG. 2B and the position shown by the solid line of FIG. 2D respectively. The transfer sheet P in which the toner image is formed is heated by the fixing device 10 (S4 of FIG. 9), thereby tentatively fixing the toner image. The transfer sheet P passing through the fixing device 10 is conveyed to the smoothing processing unit 20 while the toner image is oriented upward, the transfer sheet P is heated by the smoothing processing unit 20 (S5 of FIG. 9), and the toner image is fixed while being smoothed.

When the matte image output mode is selected, the controller 90 sets the conveying path switching member 33 and the conveying path switching member 34 to the position shown by the solid line of FIG. 2B and the position shown by the solid line of FIG. 2C respectively. The transfer sheet P in which the toner image is formed is heated by the fixing device 10 (S6 of FIG. 9), thereby tentatively fixing the toner image. The transfer sheet P passing through the fixing device 10 is oriented downward through the third path (S7 of FIG. 9). Then, the transfer sheet P is conveyed to the smoothing processing device 20, the transfer sheet P is heated by the smoothing processing unit 20 (S8 of FIG. 9), and the toner image is fixed while being smoothed.

(Coated Paper)

Figure 3:
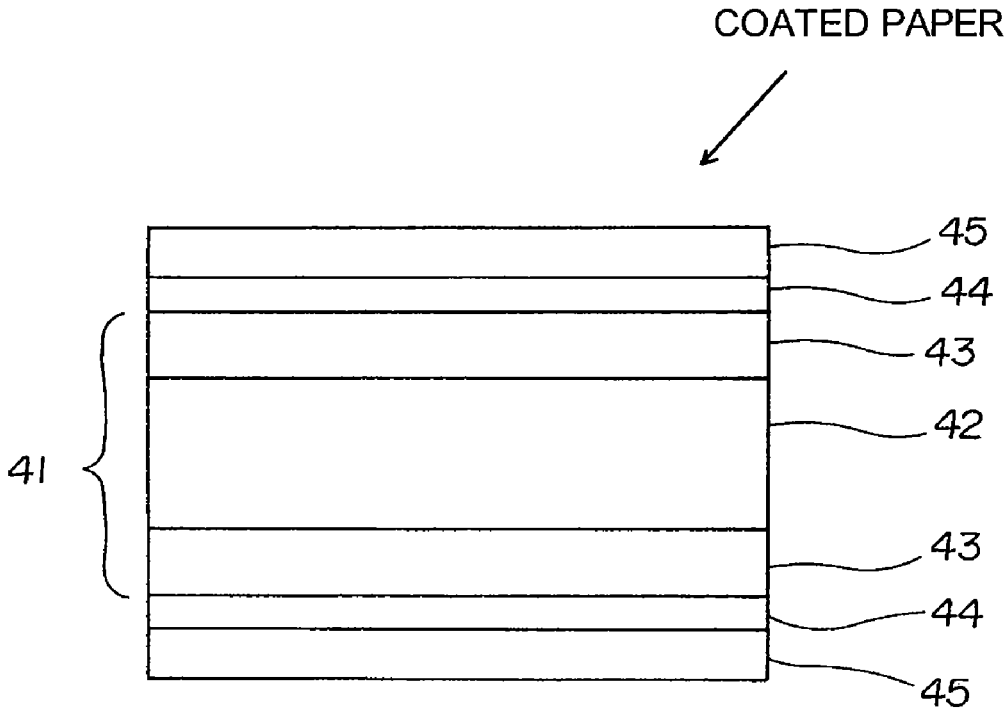
FIG. 3 is a sectional view illustrating a transfer sheet.

The coated paper including a toner image reception layer will be described below. FIG. 3 is a sectional view illustrating the coated paper.

As illustrated in FIG. 3, for the coated paper used in the embodiment, a so-called RC base paper (resin coated base paper) 41 is used. In the RC base paper 41, a resin layer 43 made of a polyethylene resin is formed on one side of base paper 42 by laminating or coating. Desirably, a resin surface of the RC base paper 41 is finished with high smoothness such that a surface of a final print output material is not roughened. A toner image reception layer 45 is provided as the outermost coat on one side of the RC base paper 41. An intermediate layer 44 may be provided if needed.

The toner image reception layer 45 is made of a thermoplastic resin, such as polyester. Preferably a glass transition temperature (Tg) ranges from 40° C. to 100° C. Preferably, a thickness of the toner image reception layer 45 ranges from about 5 μm to about 30 μm, and the thickness of the toner image reception layer 45 can be set to an optimal value according to the amount of toner used in the image forming apparatus.

Form the standpoints of a picture-like feature and a conveying property in the printer, grammage of the whole coated paper preferably ranges from 100 g/m$^2$ to 300 g/m$^2$, more preferably from 170 g/m$^2$ to 250 g/m$^2$.

(Smoothing Processing Device)

The smoothing processing device 20 includes a fixing belt 23, a heating roller 21, and cooling fans 25 and 26. The heating roller (heating member) 21 is provided inside the fixing belt (first rotating member) 23, and the heating roller 21 includes a heat source therein. The cooling fans (cooling units) 25 and 26 are provided on the downstream side of the heating roller 21 in the fixing belt rotating direction. A separation portion formed by a tension roller (separation roller) 24 is provided on the downstream side of the cooling fans 25 and 26. A pressure roller (second rotating member) 22 is located outside of the fixing belt 23 while facing the heating roller 21, and the pressure roller 22 pressurizes the heating roller 21 to form a fixing nip. That is, the fixing belt 23 and the pressure roller 22 form the nip portion therebetween in order to heat and pressurize the toner image on the transfer sheet P.

A polyimide belt having a thickness of 100 μm is used as a base material of the fixing belt 23, and silicone rubber having a thickness of 100 μm is applied to the surface of the polyimide belt. The surface of the fixing belt 23 is formed using an outer die whose inner surface is formed with a mirror finish. The belt to which rubber is applied is entrained while closely contacting an inner surface of an inner die, thereby forming the surface of the fixing belt 23 into the mirror surface (glossy surface).

The surface of the fixing belt 23 is finished with a 60°-gloss level ranging from about 90 to about 100 (JIS Z8741 mirror surface gloss level measuring method) and with surface roughness Rz of about 0.5 μm (JIS B0601 surface texture measurement).

The gloss level (60°) of the fixing belt 23 ranges from 80 to 110. Surface roughness Rz1 of the fixing belt 23 ranges from 0.5 μm to 20 μm, preferably from 0.5 μm to 15 μm. An irregularity mean spacing Sm1 of the fixing belt 23 ranges from 1 mm to 3 mm. Arithmetic mean roughness Ra1 of the fixing belt 23 ranges from 0.1 μm to 0.9 μm, preferably from 0.2 μm to 0.6 μm.

The fixing belt 23 is made of a thermosetting resin, such as polyimide. Alternatively, other heat-resistant resins and metals may be used. Heat-resistant silicone rubber and heat-resistant fluororubber can be used as the rubber layer which is an elastic layer. A fluorine or silicone layer having a high toner parting property is provided as a surface layer if needed. In the case where the surface layer is not provided, the fluororubber or silicone rubber can be used as the elastic layer.

Preferably, the total thickness of the fixing belt 23 ranges from 100 μm to 300 μm. When the total thickness of the fixing belt 23 is excessively decreased, the strength of the fixing belt 23 or pressurization for embedding the toner in the image reception layer becomes insufficient. When the total thickness of the fixing belt 23 is excessively increased, a heat quantity is increased to heat the fixing belt 23, and the embedment of the toner becomes insufficient due to deformation of the elastic layer in the fixing belt 23.

Figure 4:
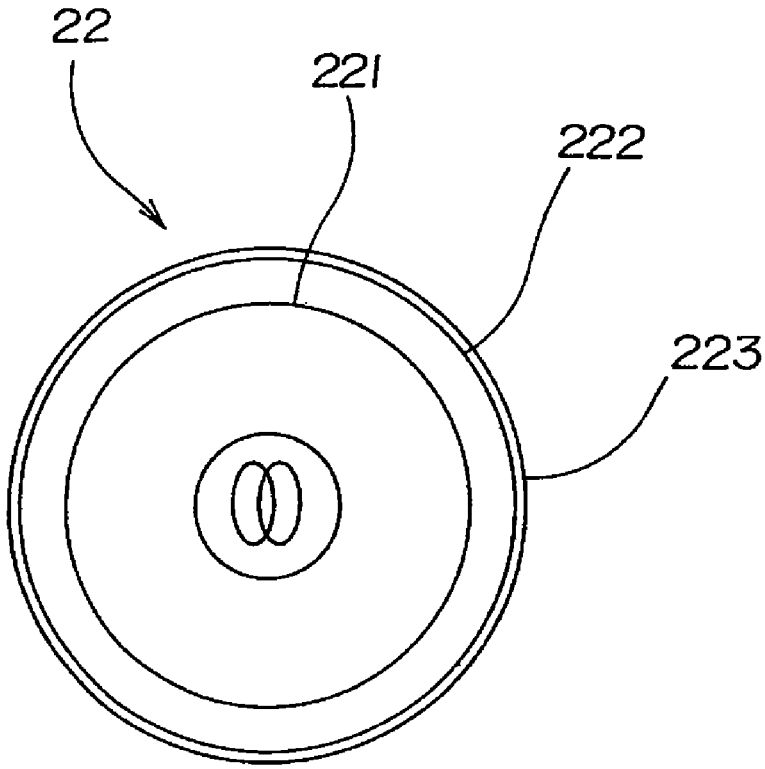
FIG. 4 is a sectional view illustrating a pressure roller.
Figure 5:
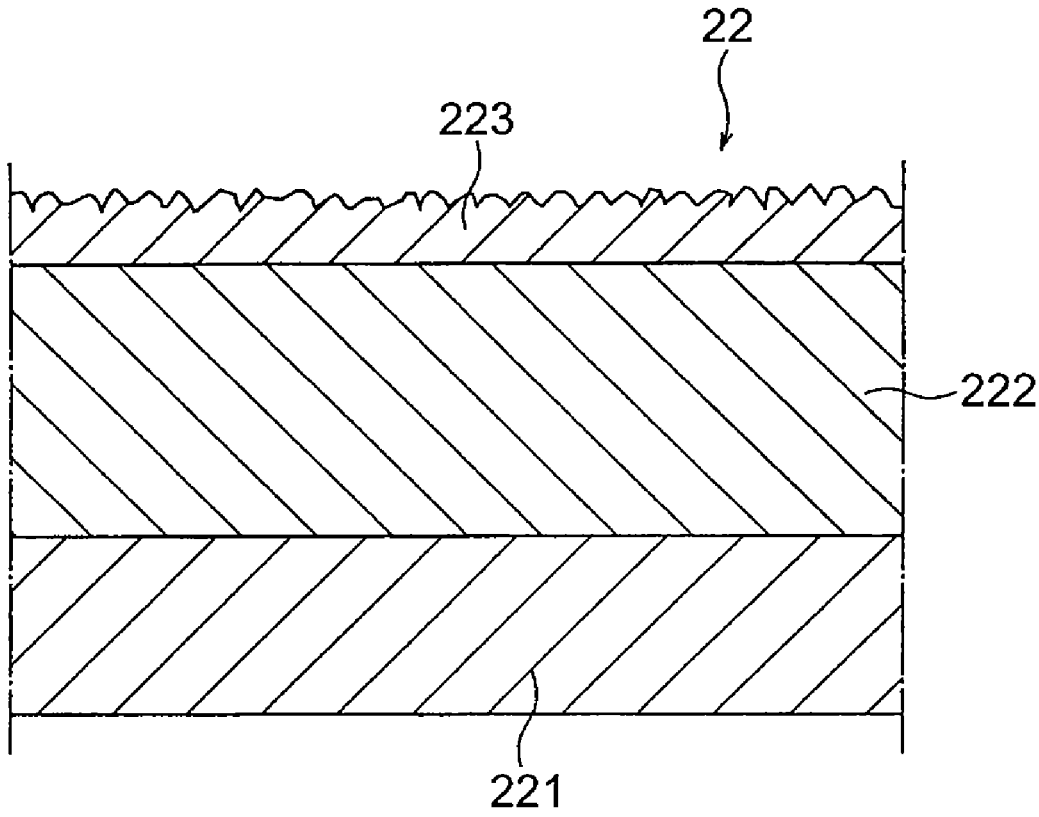
FIG. 5 is a sectional view illustrating a surface of the pressure roller.

FIG. 4 is a sectional view illustrating the pressure roller 22. As illustrated in FIG. 4, the pressure roller 22 is made of aluminum having good thermal conduction and high strength. In the pressure roller 22, silicone rubber 222 is wound around an aluminum shaft 221 with a thickness of 5 mm, and a PFA tube 223 is provided on the surface of the silicone rubber 222. FIG. 5 is a sectional view illustrating a surface of the pressure roller 22. As illustrated in FIG. 5, the surface of the pressure roller 22 is polished by sandpaper of No. 2000, and the surface is finished to form a matte surface with the 60°-gloss level of 70 and the surface roughness Rz of about 2 μm.

The gloss level (60°) of the pressure roller 22 ranges from 10 to 60, preferably from 10 to 30. Surface roughness Rz2 of the pressure roller 22 ranges from 0.5 μm from 20 μm, preferably from 0.5 μm to 15 μm. An irregularity mean spacing Sm2 of the pressure roller 22 ranges from 50 μm to 500 μm, preferably from 100 μm to 300 μm. Arithmetic mean roughness Ra2 of the pressure roller 22 ranges from 1 μm to 3 μm.

A general halogen heater can be used as the heat source, and a so-called IH system heating unit in which magnetic induction heating is adopted may be used.

The pressure roller 22 is formed by a metal roller or a roller member that has an elastic layer in a roller surface. In order to keep the pressure roller 22 at a constant temperature, the heat source may be provided in the pressure roller 22 if needed. The heating roller 21 and the pressure roller 22 are pressurized with the total pressure of 50 kg while the fixing belt 23 is interposed therebetween. The pressure roller 22 presses the transfer sheet P against the fixing belt 23.

The cooling fans 25 and 26 cool the transfer sheet P, which is moved while closely contacting the fixing belt 23, before the transfer sheet P is separated from the fixing belt 23. It is necessary that the cooling fans 25 and 26 rapidly cool the transfer sheet P passing through the pressurizing part such that the temperature of the transfer sheet P does not rise excessively and such that the image reception layer and the toner are cooled to glass transition temperatures thereof until the transfer sheet P reaches the separation portion. In the embodiment, the cooling unit is formed by the cooling fans 25 and 26. Alternatively, a heat pipe or a heat sink in which a coolant such as water is included may contact the transfer sheet P. The transfer sheet P and the fixing belt 21 can be cooled from one side or both the sides when the transfer sheet P and the fixing belt 21 are conveyed while closely contacting each other.

The separation portion separates the closely-contacted transfer sheet P and fixing belt 23 from each other, and the separation portion is formed by entraining the fixing belt 23 about the tension roller 24 such that the transfer sheet P is separated (peeled) from the fixing belt 23 by rigidity of the transfer sheet P.

(High-Gloss Mode)

In the high-gloss mode, the transfer sheet P is guided to the nip portion to output the image such that the toner image contacts the fixing belt 23 whose surface is smoothed more than that of the pressure roller 22.

In the high-gloss mode, the surface of the fixing belt 23 is kept at a temperature of 130° C. in the portion where the fixing belt 23 is entrained about the heating roller 21. The surface of the pressure roller 22 is kept at a temperature of 90° C.

The conveying path switching member 33 is located at the position of FIG. 2B, the conveying path switching member 34 is located at the position of FIG. 2D, and the transfer sheet P in which the toner image is tentatively fixed by the fixing device 10 passes through the second path and is conveyed to the smoothing processing device 20.

In the high-gloss mode, the coated paper is used as the transfer sheet P, and the coated paper contacts the fixing belt 23 at a temperature of about 80° C. The coated paper is further heated to 100 to 110° C. by contacting the fixing belt 23, and the toner image reception layer is softened and melted along with the toner. The toner is pushed into the toner image reception layer softened by the pressurization of the pressure roller 22, thereby becoming smooth.

The image reception surface into which the toner is pushed is conveyed while closely contacting the fixing belt 23, and the image reception surface passes through the cooling fans 25 and 26. The image reception surface into which the toner is pushed is cooled to 50° C. or less and solidified until the image reception surface reaches the tension roller 24, the coated paper is separated from the fixing belt 23 by the rigidity of the coated paper, and the coated paper is discharged to the outside of the image forming apparatus. The mirror surface of the fixing belt 23 is transferred to the image reception surface to become an output material having mirror glossiness.

Using a handy glossmeter PG-1M (product of Nippon Denshoku Industries Co., Ltd), the output material is measured by the JIS Z8741 mirror surface gloss level measuring method, and the resultant 60°-gloss level ranges from 88 to 100.

In the high-gloss mode, when the image reception surface of the transfer sheet P contacts the fixing belt 23, the surface of the pressure roller 22 contacts a non-image surface (surface opposite the image reception surface) of the transfer sheet P.

At this point, even if the surface of the pressure roller 22 is formed into the shape of the embodiment, the surface of the pressure roller 22 is deformed in itself because the pressure roller 22 includes the elastic layer 222. Therefore, because the non-image surface transfer sheet P is neither softened nor melted, the shape of the pressure roller 22 is not transferred to the non-image surface transfer sheet P, and the gloss level of the image is not influenced.

(Matte Image Output Mode)

In the matte image output mode, the transfer sheet P is guided to the nip portion to output the image such that the pressure roller 22 and the toner image contact each other.

In the matte image output mode, the temperatures of the fixing belt 23 and pressure roller 22 are controlled under the same conditions as the high-gloss mode. Therefore, even if the output mode is switched, a waiting time caused by a temperature change can be eliminated.

In the matte image output mode, because the image surface contacts the pressure roller 22, the heating temperature on the image reception surface side becomes lower than that in the high-gloss mode. However, because the finally-required smoothness of the matte image is lower than that of the glossy image, it is not necessary that the heating temperature on the image surface side be set as high as that in the high-gloss mode, and the same temperature conditions as the high-gloss mode can be adopted.

The conveying path switching member 33 is located at the position of FIG. 2B, the conveying path switching member 34 is located at the position of FIG. 2C, the transfer sheet P passing through the fixing device 10 is conveyed to the third path, the switchback is performed in the third path to reverse the transfer sheet P, and the transfer sheet P is conveyed to the smoothing processing device 20 while the image reception surface is oriented toward the direction in which the image reception surface contacts the pressure roller 22. In the matte image output mode, the coated paper is used as the transfer sheet P, the coated paper contacts the pressure roller 22 at a temperature of about 75° C.

The coated paper is further heated to 90° C. by contacting the pressure roller 22, and the toner image reception layer is softened and melted along with the toner. The toner is pushed into the toner image reception layer softened by the pressurization of the pressure roller 22, thereby becoming smooth. In the matte image output mode, the controller 80 stops the cooling fans 25 and 26 (or weaken a degree of belt cooling) such that the coated paper is separated from the pressure roller 22 at a high temperature.

The image reception surface into which the toner is pushed is separated from the pressure roller 22 before cooled, and the image reception surface is conveyed on the fixing belt and discharged to the outside of the apparatus, thereby obtaining the output material having the matted image reception surface.

Using the glossmeter PG-1M (product of Nippon Denshoku Industries Co., Ltd), the output material is measured by the JIS Z8741 minor surface gloss level measuring method, and the resultant 60°-gloss level ranges from 40 to 50.

(Another Pressure Roller)

Figure 6:
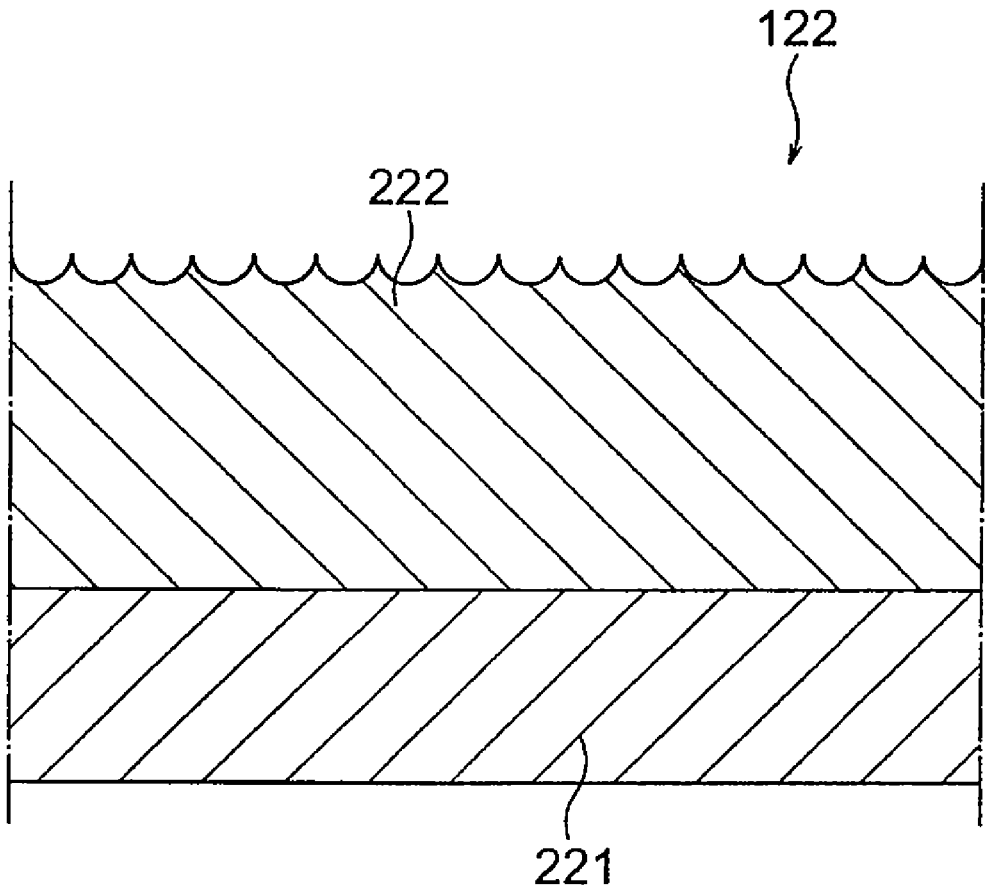
FIG. 6 is a sectional view illustrating a surface of another pressure roller.

FIG. 6 is a sectional view illustrating a surface of another pressure roller 122. As illustrated in FIG. 6, the surface of the pressure roller 122 is formed using an outer die in which hemispherical recesses having diameters of about 300 μm are regularly formed in an inner surface thereof. The molding is performed while the silicone rubber 222 applied to the shaft 221 is pressed against an inner die, whereby a regular pattern (hemispherical recesses having diameters of about 300 μm) is formed in the surface of the pressure roller 122.

The pressure roller 122 is used to output the image. The surface temperature of the fixing belt 23 is kept at a temperature of 100° C. in the part where the fixing belt 23 is entrained about the heating roller 21, the surface of the pressure roller 122 is kept at a temperature of 110° C., and the image is formed in the matte image output mode similar to the case in which the pressure roller 22 is used. A toner step does not exist in the image surface, and a regularly hemispherical shape is formed. In the output material, the 60°-gloss level ranges from 20 to 30.

(Image Reception Layer Surface of Image Output Sample)

FIG. 7 illustrates a state of an image reception layer surface of an image output material.

Figure 7A:
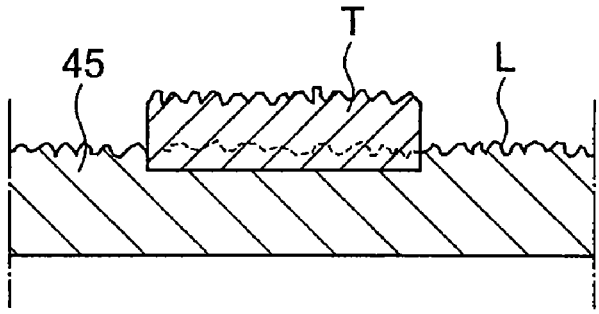
FIGS. 7A to 7D are sectional views illustrating a surface of an image output material.

FIG. 7A illustrates a state of the image reception layer surface of the image output material when the image output material is heated only by the fixing device 10 while not heated by the smoothing processing device 20. As illustrated in FIG. 7A, a step between toner T and image reception layer L remains in the surface.

Figure 7B:
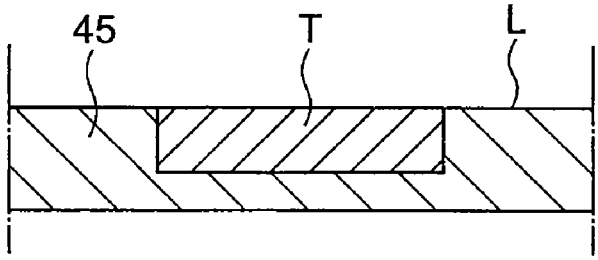

FIG. 7B illustrates a state of the image reception layer surface of the image output material when the image is outputted in the high-gloss mode. As illustrated in FIG. 7B, the toner T is pushed into the image reception layer L to substantially eliminate the step, and a good glossy surface is obtained.

Figure 7C:
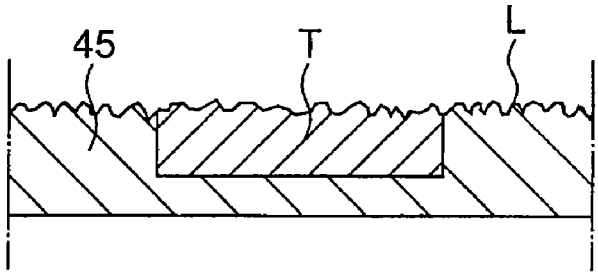

FIG. 7C illustrates a state of the image reception layer surface of the image output material when the image is formed in the matte image output mode using the pressure roller 22. As illustrated in FIG. 7C, the toner T is pushed into the image reception layer L to substantially eliminate the step formed by the toner, and the coarse surface is obtained because of the surface of the pressure roller 22.

Figure 7D:
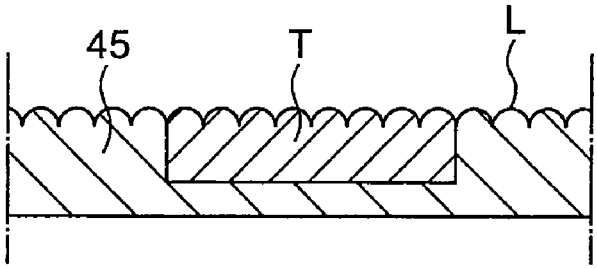

FIG. 7D illustrates a state of the image reception layer surface of the image output material when the image is formed in the matte image output mode using the pressure roller 122. As illustrated in FIG. 7D, the toner T is embedded in the image reception layer L to substantially eliminate the step formed by the toner, and the surface becomes the regularly hemispherical shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-174698, filed Jul. 3, 2007, which is hereby incorporated by reference herein in its entirety.

What is claimed is:

1. An image glossing apparatus comprising:

first and second heating rotating members which contact each other to form a nip portion, a toner image on a recording material being heated in the nip portion, a surface of the second heating rotating member being rougher than a surface of the first heating rotating member;

a cooling unit which cools the recording material, moved while contacting the first heating rotating member, before the recording material is separated from the first heating rotating member; and a mode performing unit which performs a high-gloss mode and a low-gloss mode, the recording material is conveyed to and heated by the nip portion such that the toner image contacts the first heating rotating member in the high-gloss mode, and the recording material is conveyed to and heated by the nip portion such that the toner image contacts the second heating rotating member in the low-gloss mode, wherein both a surface roughness Rz1 of the first heating rotating member and a surface roughness Rz2 of the second heating rotating member range from 0.5 μm to 20 μm, an irregularity mean spacing Sm1 of the first heating rotating member ranges from 1 mm to 3 mm, an irregularity mean spacing Sm2 of the second heating rotating member ranges from 50 μm to 500 μm, a surface roughness Ra1 of the first heating rotating member ranges from 0.1 μm to 0.9 μm, and a surface roughness Ra2 of the second heating rotating member ranges from 1 μm to 3 μm.

2. The image glossing apparatus according to claim 1, further comprising a reversing unit which reverses the recording material conveyed toward the nip portion.

3. The image glossing apparatus according to claim 1, wherein a degree of cooling of the low-gloss mode is lower than that of the high-gloss mode.

4. The image glossing apparatus according to claim 1, wherein a gloss level (60°) of the first heating rotating member ranges from 80 to 110 and a gloss level (60°) of the second heating rotating member ranges from 10 to 60.

* * * * *